United States Patent [19]

Bissett

[11] 4,069,867

[45] Jan. 24, 1978

[54] CYCLIC FLOW UNDERGROUND COAL GASIFICATION PROCESS

[75] Inventor: Larry A. Bissett, Morgantown, W. Va.

[73] Assignee: The United States of America as represented by the United States Department of Energy, Washington, D.C.

[21] Appl. No.: 751,624

[22] Filed: Dec. 17, 1976

[51] Int. Cl.[2] ..... E21C 43/00

[52] U.S. Cl. ..... 166/256; 299/2

[58] Field of Search ..... 166/256–262; 299/2

[56] References Cited

U.S. PATENT DOCUMENTS

| | | | |
|---|---|---|---|
| 947,608 | 1/1910 | Betts | 299/2 |
| 3,044,545 | 7/1962 | Tooke | 166/260 |
| 3,506,309 | 4/1970 | Von Hippel | 299/2 |

*Primary Examiner*—Ernest R. Purser

*Attorney, Agent, or Firm*—Dean E. Carlson; Stephen D. Hamel; Earl L. Larcher

[57] ABSTRACT

The present invention is directed to a method of in situ coal gasification for providing the product gas with an enriched concentration of carbon monoxide. The method is practiced by establishing a pair of combustion zones in spaced-apart boreholes within a subterranean coal bed and then cyclically terminating the combustion in the first of the two zones to establish a forward burn in the coal bed so that while an exothermic reaction is occurring in the second combustion zone to provide $CO_2$-laden product gas, an endothermic CO-forming reaction is occurring in the first combustion zone between the $CO_2$-laden gas percolating thereinto and the hot carbon in the wall defining the first combustion zone to increase the concentration of CO in the product gas. When the endothermic reaction slows to a selected activity the roles of the combustion zones are reversed by re-establishing an exothermic combustion reaction in the first zone and terminating the combustion in the second zone.

5 Claims, 1 Drawing Figure

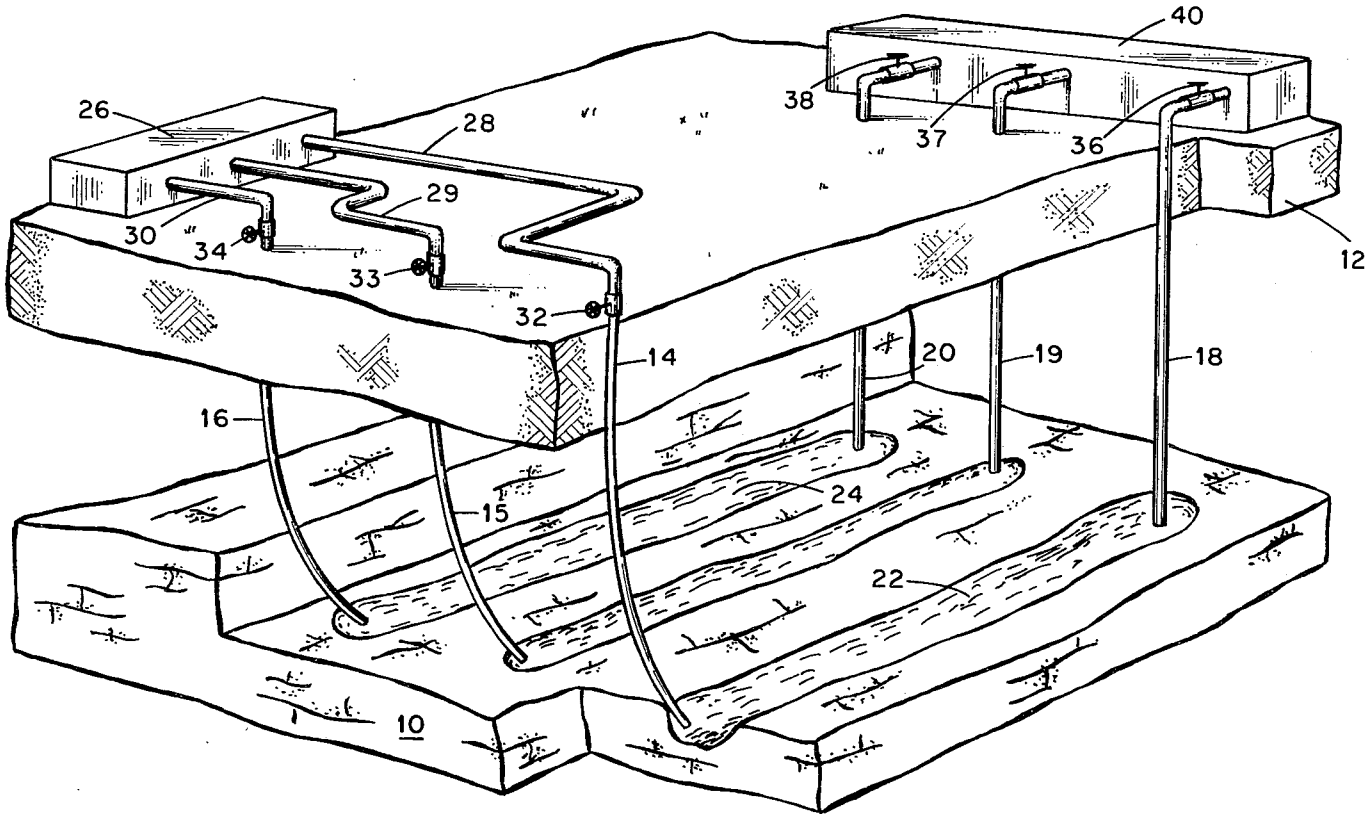
12
40
18
36
19
37
20
22
38
24
14
32
28
15
29
33
10
34
16
30
26

CYCLIC FLOW UNDERGROUND COAL GASIFICATION PROCESS

The present invention relates generally to a method for in situ gasification of subterranean coal beds and, more particularly, to such a method wherein product gases are provided with a CO concentration greater than hereintofore obtainable.

Recovery of carbon-containing gases from underground strata containing coal by employing in situ combustion process is becoming of increasing importance due to the energy requirements of the world. The in situ combustion process is initiated in the coal bed and the resulting combustion zone is caused to expand through the strata in either a reverse or forward burn. The heat of combustion gasifies the coal to provide recoverable gaseous products which contain considerable energy values. Several variables are associated with in situ combustion processes which determine operating parameters; for example, in a conventional forward or reverse burn in situ combustion process, the underground strata is penetrated by boreholes at spaced-apart locations with the spacing being determined by such factors as the reliable air (combustion supporting medium), injection pressure the air velocity in the coal bed, permeability of the coal bed, and the particular type of coal containing the recoverable gaseous products. In the recovery of carbon-containing gases from subterranean coal beds by gasifying the coal, the gaseous products of the forward burn process flow through the coal bed to the producer well where the gaseous products are withdrawn. The control of the combustion zone with respect to its configuration and rate of propagation through the subterranean coal presents some problems in that these operating parameters must be carefully controlled so as to maintain the BTU content of the gas at an acceptable level. Normally, forward burn gasification is limited to low-coking coals, such a lignite and sub-bituminous coals, since coals with relatively higher coking values release excessive tar vapors which are carried with the gaseous products into cooler regions of the coal bed where the vapors condense and reduce the permeability of the coal bed.

Several efforts have been previously made for enhancing the recovery of energy values from coal beds by in situ combustion processes. One such effort is disclosed in assignee's U.S. Pat. No. 3,933,447, which issued Jan. 20, 1976, and is entitled "Underground Gasification of Coal" by Joseph Pasini, III et al. This patent teaches that efficient gasification of underground coal beds may be achieved by penetrating the coal bed with spaced-apart directionally drilled boreholes which project along a horizontal plane within the coal bed and extend in a directional normal to the plane of maximum permeability. The combustion of the coal is initiated in one of the horizontal boreholes and product gases are recovered from the other borehole which is spaced from the combustion zone along the plane of maximum permeability. The combustion process in this patent is enhanced by utilizing the natural fracture system extending between the injection boreholes (combustion zone) and the producer borehole so as to ensure the production of the product gases and the propagation of a combustion therebetween as well as to ensure the removal of product gases. It is further contemplated in this patent to induce fractures in the coal bed extending between the boreholes so as to further enhance the removal of the product gases and increase the efficiency of the combustion operation.

While the use of directionally drilled boreholes, as described in assignee's aforementioned patent, provides an improvement in the coal gasification art, there are still some shortcomings present which detract from known coal gasification processes. For example, a primary concern in a coal gasification operation is the production of gas with a sufficiently high BTU content to support combustion. Normally, a calorific value of about 80 BTU/SCF is required for supporting combustion in an efficient manner. The product gases resulting from typical gasification operations are normally composed of hydrocarbons, e.g., methane, as well as carbon dioxide and carbon monoxide. The carbon dioxide in this mixture does not contribute to the heating value of the product gas but normally comprises about 12–18 percent of the gaseous product. The carbon and the oxygen of the combustion-supporting medium apparently preferentially react to form carbon dioxide rather than carbon monoxide in the combustion zone, with carbon monoxide resulting from the combined effects of the steam-carbon reaction ($C + H_2O \rightarrow CO + H_2$) and the water-gas shift reaction ($CO_2 + H_2 \rightarrow H_20 + CO$). Little, if any, of the carbon monoxide results from the carbon-carbon dioxide reaction ($C + CO_2 \rightarrow 2\ CO$) apparently due to the absence of a substantive source of hot carbon for the carbon dioxide to react with, and the inadequate gas-solid contact times present in conventional underground gasification schemes. Without the occurrence of the carbon-carbon dioxide reaction, plus the presence of steam in the combustion zone, part of the carbon monoxide that is formed is converted to hydrogen and carbon dioxide, so that on a nitrogen-free basis, the gaseous product will usually contain substantially more carbon dioxide than carbon monoxide, and slight more hydrogen than carbon monoxide.

Accordingly, it is the primary aim of the present invention to convert a substantial portion of the carbon dioxide to carbon monoxide in situ. This is accomplished by providing a substantive hot carbon source with which the carbon dioxide can adequately contact and be converted to carbon monoxide according to the reaction ($C + CO_2 \rightarrow 2\ CO$). Furthermore, the increased concentration of carbon monoxide in the reaction zone can react with steam in a gas phase reaction to produce additional carbon dioxide and hydrogen ($CO + H_2O \rightarrow CO_2 + H_2$). This additional carbon dioxide can then react with hot carbon to provide additional carbon monoxide so that the combined effect of these two reactions is to substantially increase the concentrations of carbon monoxide and hydrogen in the gaseous product, and to substantially decrease the concentrations of carbon dioxide and steam in the gaseous product. The series of reactions is believed to be capable of adding about 20 to 90 BTU/SCF to the heating value of the product gas. To practice the method of the present invention, the $CO_2$ converting reaction takes place by employing dual combustion zones in the subterranean coal beds with one of the combustion zones reacting exothermically with the combustion-supporting medium (air) to provide the gaseous product which in turn is transmitted through the coal bed to the other combustion zone which is sufficiently hot to support the endothermic reaction necessary to provide the $CO_2$ converting reaction. The $CO_2$-hot carbon contact utilizes a forward burn wherein the two combustion zones are pneumatically linked together with each combustion zone initially fired exothermically with injected combustion-supporting medium to provide each zone with a high temperature in the order of 2000° F. After combustion is initiated in both zones, the supply of the combustion-supporting medium is maintained in the first of the two combustion zones to form the carbon dioxide containing product gases with this combustion reaction maintaining the first combustion zone at a temperature of 2000° F. These hot gaseous products of combustion percolate through the coal bed and enter the second combustion zone where the carbon dioxide endothermically reacts with the hot carbon defining the wall of the second combustion zone to form carbon monoxide. The gases are then extracted from the second combustion zone to provide the product gas usable in the desired operation. When the temperature in the second combustion zone in which the endothermic reaction is occurring decreases to about 1700° F, the operation of the combustion zones is reversed or cycled by switching the supply of the combustion-supporting medium from the first combustion zone to the second combustion zone so as to re-establish the exothermic combustion reaction in the second combustion zone and halt the exothermic combustion reaction in the first combustion zone. With this change in reactions, the product gases will then flow through the coal bed from the second combustion zone to the first combustion zone to provide the endothermic carbon monoxide-forming reaction.

From an energy viewpoint, the exothermic combustion reaction releases at most about 115,000 BTU per pound mole of carbon dioxide produced when air is used as the oxygen-containing medium. On the other hand, assuming that the coal bed is relatively cool between the two combustion zones so that the hot gases leaving the first combustion zone are cooled before entering the second combustion zone, the endothermic carbon monoxide-producing reaction requires from 307,000 to 918,000 BTU per pound mole of carbon dioxide reacted in the temperature range 1700° to 2000° F. with the average being approximately 404,000 BTU per pound mole of carbon dioxide reacted. Even if the coal bed between the two combustion zones is hot so that the sensible heat of the gaseous products leaving the first combustion zone can be fully utilized in the second combustion zone, the endothermic carbon monoxide-producing reaction still requires from 179,000 to 319,000 BTU per pound mole of carbon dioxide reacted in the temperature range 1700° to 2000° F, with the average being approximately 196,000 BTU per pound mole of carbon dioxide reacted. Thus, the temperatures in the exothermic zone will not recover to 2000° F before the temperatures in the endothermic zone drop to a level which will no longer sustain an efficient carbon monoxide-proucing reaction. Therefore, the continued cycling, without interruption by some other mode of operation, between the two combustion zones would lead to temperature extinction in both combustion zones. As will be described in detail below, temperature recuperation of the combustion zones, i.e., re-establishing the 1700°–2000° F temperatures in the combustion zones, is provided so that the cycling operation may again be efficiently effected.

Other and further objects of the invention will be obvious upon an understanding of the illustrative method about to be described, or will be indicated in the appended claims, and various advantages not referred to herein will occur to one skilled in the art upon employment of the invention in practice. The gas compositions and heating values set forth herein are presented on a water-free basis using air as the combustion-supporting medium. Different gas compositions and heating values would be derived by using oxygen or oxygen-enriched air as the combustion-supporting medium.

A preferred embodiment of the invention has been chosen for the purpose of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated.

In the accompanying drawing, the FIGURE is a highly schematic perspective view showing an earth formation containing the subterranean coal bed which has been provided with a borehole and valving arrangement suitable for practicing the method of the present invention.

Described generally, the present invention is directed to a method for increasing the concentration of carbon monoxide in the product gases resulting from the in situ gasification of coal in a subterranean coal-bearing formation. The concentration of carbon monoxide in the product gas as produced by practicing previously known in situ gasification techniques is within the range of about 4 to 10 percent. By practicing the method of the present invention, the percentage of the carbon monoxide in the product gases can be increased to about 11 to 29 percent. This increse in the concentration of the carbon monoxide, plus the increase in the concentration of hydrogen by the mechanism decribed herein, increases the heating value of the product gas about 20 to 90 BTU/SCF in the temperature range 1700° to 2000° F, with the average increase being about 59 BTU/SCF.

The method of the present invention may be practiced by establishing at least a pair of combustion zones at spaced-apart locations within a subterranean coal bed by initiating an exothermic combustion reaction within both of the combustion zones and supporting the reaction by conveying a combustion-supporting medium thereinto while discharging product gases from each combustion zone. After the exothermic reactions have been established, the flow of combustion-supporting medium is maintained to only the first of the two combustion zones and the discharge of the product gases is maintained from only the second combustion zone. The terminations of the flow of the product gases and the combustion-supporting medium from the first and second zones, respectively, causes the product gases resulting from the exothermic combustion reaction in the first combustion zone to flow through the coal bed into the second combustion zone where the carbon dioxide in the product gases endothermically reacts with the hot carbon defining the walls of the second combustion zone to effect the conversion of carbon dioxide to carbon monoxide.

The exothermic reaction in the combustion zone prior to terminating the flow of combustion-supporting medium thereinto provides a temperature of about 2000° F which heats the carbon in the walls defining the combustion zone to provide the desired endothermic reaction with the carbon dioxide-containing product gases when the latter ar percolated into the combustion zone. The endothermic reaction for producing the carbon monoxide continues until the temperature of the hot carbon decreases to about 1700° F which in turn increases the $CO_2$ content of the gaseous product discharging from the zone to a predetermined value of about 14 percent. When the temperature nears or reaches this level, functions of the first and second combustion zones, as described above, are reversed. To effect this reversal, the flow of the combustion-supporting medium is interrupted to the first combustion zone and introduced into the second combustion zone while the discharge of the product gases is interrupted from the second combustion zone and initiated in the first combustion zone. Thus, with this switching, the combustion-supporting medium again exothermically reacts in the second combustion zone to heat it approximately 2000° F to provide the product gases which percolate through the coal bed in the opposite direction and into the first combustion zone where the $CO_2$ reacts with the hot carbon provided therein by the exothermic reaction just terminated.

At temperatures above about 2000° F very little improvement is realized in the quality of the product gases while such temperatures may cause excessive ash softening or fusing to occur which could significantly impair the permeability of the coal bed. Also, at temperatures less than about 1700° F little advantage is realized in the production of CO-enriched product gas over conventional in situ combustion processes. Also, the rate of reaction at temperatures less than about 1700° F is relatively slow so as to inhibit the production of CO-enriched product gas with practical gas-solid contact times.

When the cycling of the combustion zones is continued until the $CO_2$ content in the product gas from both combustion zones reaches a level of about 14 percent, the cycling operation is terminated and both combustion zones are refired exothermically to restore the 2000° F temperature in each zone. To achieve the temperature restoration or recuperation in both combustion zones a valved borehole is provided in the coal bed at a location intermediate the two combustion zones. The outlet from the central borehole is open and the discharge of gas from the two combustion zones is stopped while air is directed into both combustion zones to provide the exothermic combustion therein. The gaseous products of combustion pass through the coal bed from both combustion zones and are exhausted from the outlet in the central borehole. After the temperatures in both combustion zones reach about 2000° F the outlet from the central borehole is closed and the cycling operation, as hereinabove described, is re-established and continued with subsequent temperature restoration being effected, as required, until the combustion zones merge with the central borehole.

During the period of temperature recuperation the product gas being removed from the central borehole will normally have a calorific value typical for that produced in forward burn gasification. The recovery of the high temperatures (about 2000° F) in the combustion zones may be readily determined by a relatively steady CO concentration of about 5 to 7 percent in the product gas.

Described more specifically and with reference to the accompanying drawing, the method of the present invention for recovering carbon-containing gases from subterranean coal beds by employing in situ gasification procedures may be practiced by employing the illustrated drilling scheme. As shown in the drawing, the subterranean coal bed 10 is disposed at some level below one or more layers of overburden 12. Three directional boreholes 14, 15 and 16 are drilled from the surface of the overburden 12 on a slant so as to penetrate the subterranean coal bed along a substantially horizontally oriented path with respect to the coal bed 10 or with respect to the overburden 12. The boreholes 14–16 may be drilled either continuously from the surface to the overburden 12 through a selected portion of the coal bed 10 and back to the surface of the overburden 12 or alternatively from the surface of the overburden 12 into the coal bed 10 and terminated at some selected location therein, as shown. The drilling of the boreholes 14–16 within the coal bed 10 may be initiated at any desired vertical angle from the surface of the overburden 12 with this angle depending upon the depth of the coal bed and the drilling equipment employed. The drilling procedure should be such that when the boreholes 14–16 enter the coal bed 10 they are traveling in a substantially horizontal direction so as to penetrate a desired portion of the coal bed 10. The use of such horizontal boreholes substantially minimizes the number of boreholes necessary to contact a relatively large segment of the coal bed. Boreholes 14–16 extend horizontally within the coal bed 10 along a plane oriented substantially perpendicular to the plane of maximum permeability so that maximum fluid flow through the coal bed is along planes extending between boreholes 14–16. Normally, the coal bed 10 will be penetrated with additional series of horizontal boreholes similar to boreholes 14–16 with these additional boreholes being parallel to and separated from one another at selected distances in the range of about 50 to 500 feet depending upon the particular characteristics of the coal bed. In the preferred practice of the present invention, three vertically extending boreholes 18, 19 and 20 would be provided at the terminal ends of the horizontal boreholes 14, 15, and 16, respectively. This interception of the horizontal boreholes by the vertical boreholes provides satisfactory results and is substantially less expensive than extending the horizontal boreholes back to the surface as hereinabove described. Further details relating to the drilling of horizontal boreholes are set forth in assignee's aforementioned patent.

Upon completion of the aforementioned drilling steps, combustion may be initiated in any suitable well-known manner in both boreholes 14 and 16 so as to provide combustion zones 22 and 24 over the entire length of the boreholes 14 and 16 within the coal bed. Borehole 15, which is intermediate boreholes 14 and 16, is utilized for temperature recuperation in combustion zones 22 and 24 as will be described in detail below. The combustion-supporting medium, i.e., air, is injected into the coal bed 10 from a suitable source, such as generally shown at 26, through conduit systems 28, 29, and 30 coupled to the boreholes. With the combustion-supporting gas flowing into boreholes 14 and 16, the combustion zones 22 and 24 burn exothermically to provide a combustion temperature of about 2000° F while forming a gaseous product which is exhausted or extracted from the combustion zones via the vertical boreholes 18 and 20. In order to control the gasification operation in accordance with the teachings of the present invention, each of boreholes 14, 15, 16, 18, 19, and 20 is provided with the flow control valves at the well heads, such as indicated at 32, 33, 34, 36, 37 and 38, respectively. Valves 32, 34, 36 and 38 are selectively operable to control the rate of flow of the combustion-supporting medium into and the extraction of the combustion product from the combustion zones. The valves 33 and 37 at the boreholes 15 and 19 are normally closed during the initiation of the combustion in zones 22 and 24 and during the cycling combustion operation. The function of valves 33 and 37 will be discussed below. The control of the combustion supporting medium and the combustion products may be achieved by employing a suitable monitoring system, such as generally shown at 40, which may be used to analyze and selectively control the valves to alter, terminate, or initiate the flow of the combustion-supporting medium and the combustion products into or from either combustion zone by analyzing the composition of the gaseous product.

The valves 32, 34, 36 and 38 are initially opened so as to establish and support combustion in combustion zones 22 and 24 with the combustion products being extracted via the boreholes 18 and 20. When the combustion zones reach temperatures of about 2000° F, as caused by the exothermic reaction of the combustion-supporting medium with the coal, the valves are selectively operated to provide the carbon monoxide enriched product gases. To provide this goal of the present invention, the flow of the combustion-supporting medium into combustion zone 24 is terminated but continues to flow into the combustion zone 22. The extraction of th combustion products is terminated through well bore 18 while valve 38 is left open for exhausting the combustion products through well bore 20. With this arrangement of flow patterns, the combustion products from combustion zone 22 percolate through the coal bed 10 into the combustion zone 24 where the $CO_2$ in the combustion product contacts the hot carbon walls defining the combustion chamber 24 to endothermically react therewith and provide the enriched carbon monoxide. When the temperature of the hot carbon in combustion zone 24 decreases to where the yield of enriched carbon monoxide falls to less than about 11 percent of the product gas, the valves 32 and 38 are closed and the valves 34 and 36 are opened. By so switching the valves, the combustion-supporting medium then flows into combustion zone 24 to exothermically react with the coal and thereby reinstate the temperature of the combustion zone back up to about 2000° F. The product gas from this combustion zone then percolates in the opposite direction through the coal bed 10 into combustion zone 22 where the exothermic reaction has just been terminated. The $CO_2$ in the combustion products then reacts with the hot carbon in the walls of combustion zone 22 to provide the carbon monoxide enriched product gas which is extracted from the combustion zone via well bore 18.

The cycling of th combustion zones may be continued until the temperature in both combustion zones decreases to where the $CO_2$ content in the gas product from both combustion zones reaches 14 percent or greater. When this condition is present, the cyclic method of the present invention has essentially no advantage over conventional in situ gasification processes. Accordingly, in order to re-establish the high CO concentration in the gas product and the cyclic combustion operation, the temperatures in both combustion zones are increased to about 2000° F. This temperature recuperation is achieved by closing valves 36 and 38 and opening valves 32, 34, and 37. Valve 33 also remains closed during the temperature recuperation cycle. With the air flowing into both combustion zones 22 and 24, exothermic combustion takes place therein which results in a rapid increase in temperature in both zones. The gaseous products produced by the exothermic combustion pass from combustion zones 22 and 24 through the coal bed 10 into the boreholes 15 where these gases exit through borehole 19 and open valve 37. When the temperature in combustion zones 22 and 24 reach about 2000° F as indicated by a relatively constant 5–7 percent concentration of CO in the gases exiting borehole 15, the valve 37 is closed and the cyclic combustion operation is again established by the selective sequential operation of valves 32, 34, 36, and 38.

In the event the borehole 15 does not have adequate capacity for satisfactorily exhausting the gaseous products from both combustion zones 22 and 24 during the aforementioned temperature recuperation step it may be desirable to enlarge the borehole 15. This enlargement of a borehole 15 may be readily accomplished over the length thereof by in situ combustion procedures similar to those utilized for establishing combustion zones 22 and 24. For this borehole enlarging operation valve 33 is opened to provide the air for supporting the combustion and valve 37 is opened for exhausting the gaseous products resulting from the combustion of the coal.

The use of the central borehole 15 is necessary in the method of the present invention for effecting the temperature recuperation in combustion zones 22 and 24. Temperature recuperation by introducing the air into each combustion zone while discharging the gaseous products from each zone as used in the initial establishment of the combustion zones, as described above, becomes increasingly difficult with increasing volume of the combustion zones. This difficulty is due to the fact that the air will tend to flow through the combustion zone and exiting without being consumed in the combustion process at the burn front with this tendency increasing with increasing volume in the combustion zones. Thus, in order to restore the temperature in the combustion zones, it was found necessary to efficiently utilize the combustion-supporting medium by forcing the gaseous products to exit the combustion zones through the coal be and borehole 15 so as to bring the air in contact with the burn front for supporting combustion.

It will be seen that the present invention provides a substantial improvement in in situ combustion processes for the recovery of relatively high BTU product gas from subterranean coal beds with the concentration of carbon monoxide in the product gas being at a higher level than previously obtainable. Further, the use of the cycling operation as well as the re-establishing of the combustion zone provides a ready source of hot carbon so as to sustain the carbon monoxide enriching reaction in a highly economical manner. An additional feature of the present invention is that the cycling of the combustion zone operation together with the attendant reversal of flow directions for the product gases through the coal bed assures that potential blockage of the flow paths in the coal bed between combustion zones due to the presence of viscous fluids will be substantially minimized since the flow reversal will effectively flush these fluids from the coal bed.

What is claimed is:

1. A method for increasing the concentration of carbon monoxide in the gaseous product resulting from the in situ gasification of coal in a subterranean coal bed, comprising the steps of providing a pair of boreholes penetrating the coal bed at locations spaced from one another a distance sufficient to establish a combustion zone in each borehole, initiating an exothermic combustion reaction in both of said boreholes to establish combustion zones therein, supporting the combustion of the coal to provide a temperature in each combustion zone of about 2000° F by conveying combustion-supporting medium into and discharging the resulting gaseous products of combustion from each combustion zone, maintaining the flow of combustion-supporting medium to the first combustion zone while interrupting the flow of combustion-supporting medium to the second combustion zone, maintaining the discharge of the gaseous products from the second combustion zone while interrupting the discharge of the gaseous products from the first combustion zone, said steps of maintaining and interrupting the flow of the combustion-supporting medium and the discharge of the gaseous products causing the gaseous products from the first combustion zone to pass through the coal bed disposed between the boreholes in a forward burn configuration into the second combustion zone where carbon dioxide in the gaseous products reacts endothermically with hot carbon defining the walls of the second combustion zone to effect the conversion of carbon dioxide to carbon monoxide.

2. The method claimed in claim 1 wherein the functions of said first and second combustion zones are reversed when the temperature in said second combustion zone sufficiently decreases to retard the endothermic reaction to where the concentration of carbon monoxide in the gaseous product discharged from the second combustion zone drops to a preselected value, said functions of the first and second combustion zones being reversed by the steps of reintroducing the flow of the combustion-supporting medium into said second combustion zone to re-establish an exothermic reaction therein and terminating the flow of the combustion-supporting medium into said first combustion zone, and discharging the gaseous products from said first combustion zone and interrupting the discharge of the gaseous products from said second combustion zone.

3. The method claimed in claim 2 wherein the functions of said first and second combustion zones are reversed when said temperature in the second combustion zone decreases to about 1700° F.

4. The method claimed in claim 2 wherein the functions of the first and second combustion zones are reversed when the concentration of the carbon monoxide drops to 11 percent of the gaseous products discharged from the second combustion zone.

5. The method claimed in claim 2, including the additional steps of providing a further borehole in said coal bed at a location intermediate said pair of boreholes, introducing combustion-supporting medium into said first and second combustion zones when the temperature in both combustion zones sufficiently decrease to retard the endothermic reaction therein to where the concentration of carbon monoxide in the gaseous product drops to a preselected value, interrupting the discharge of the gaseous products from said first and second zones and discharging gaseous products from said further borehole, and maintaining the flow of the combustion supporting medium in said first and second combustion zones and the discharge of the gaseous products through said further borehole until a temperature of about 2000° F is achieved in both said first and second combustion zones.

* * * * *